US010610451B2

(12) United States Patent
Gray

(10) Patent No.: US 10,610,451 B2
(45) Date of Patent: Apr. 7, 2020

(54) PORTABLE TEMPERATURE CONTROLLED CONTAINER

(71) Applicants: DeltaTrak Inc., Pleasanton, CA (US); David Gray, County Donegal (IE)

(72) Inventor: David Gray, County Donegal (IE)

(73) Assignee: DeltaTrak Inc., Pleasanton, CA (US)

( * ) Notice: Subject to any disclaimer, the term of this patent is extended or adjusted under 35 U.S.C. 154(b) by 319 days.

(21) Appl. No.: 15/029,778

(22) PCT Filed: Oct. 17, 2014

(86) PCT No.: PCT/EP2014/072359
§ 371 (c)(1),
(2) Date: Apr. 15, 2016

(87) PCT Pub. No.: WO2015/055836
PCT Pub. Date: Apr. 23, 2015

(65) Prior Publication Data

US 2016/0243000 A1 Aug. 25, 2016

(30) Foreign Application Priority Data

Oct. 17, 2013 (GB) ..... 1318405.6

(51) Int. Cl.
*F25B 21/02* (2006.01)
*A61J 1/16* (2006.01)
(Continued)

(52) U.S. Cl.
CPC ..... *A61J 1/165* (2013.01); *F25B 21/02* (2013.01); *F25D 3/08* (2013.01); *F25D 11/006* (2013.01);
(Continued)

(58) Field of Classification Search
CPC .... A61J 1/165; A61J 2200/44; A61J 2200/72; F25B 21/02; F25B 2321/023;
(Continued)

(56) References Cited

U.S. PATENT DOCUMENTS 5,522,216 A * 6/1996 Park ..... F25B 21/02 62/3.6
5,605,048 A 2/1997 Kozlov
(Continued)

FOREIGN PATENT DOCUMENTS

CN 102005972 4/2011
CN 103075856 5/2013
(Continued)

*Primary Examiner* — Joseph F Trpisovsky

(57) ABSTRACT

This invention relates to a portable temperature controlled container comprising a body having a storage compartment, an opening to permit access to the storage compartment and an insulated lid. The container comprises a fan, a heat sink and a first thermoelectric device, as well as a first phase change material and a second thermoelectric device in thermal communication with both the first phase change material and the storage compartment. The second thermoelectric device in thermal communication with both the first phase change material and the storage compartment is operable to transfer energy in the form of heat between the storage compartment and the first phase change material. The thermoelectric devices can be Peltier elements.

13 Claims, 10 Drawing Sheets

(51) Int. Cl.

| | |
|---|---|
| ***F25D 3/08*** | (2006.01) |
| ***F25D 16/00*** | (2006.01) |
| ***F25D 11/00*** | (2006.01) |
| *F25D 29/00* | (2006.01) |
| *F28D 21/00* | (2006.01) |

(52) U.S. Cl.
CPC ..... *F25D 16/00* (2013.01); *A61J 2200/44* (2013.01); *A61J 2200/72* (2013.01); *F25B 2321/023* (2013.01); *F25B 2321/0251* (2013.01); *F25B 2321/0252* (2013.01); *F25D 29/00* (2013.01); *F25D 2201/10* (2013.01); *F25D 2303/0843* (2013.01); *F25D 2400/02* (2013.01); *F25D 2600/04* (2013.01); *F25D 2700/12* (2013.01); *F28D 2021/0029* (2013.01)

(58) Field of Classification Search
CPC ..... F25B 2321/0251; F25B 2321/0252; F25D 3/08; F25D 11/006; F25D 16/00; F25D 29/00; F25D 2201/10; F25D 2303/0843; F25D 2400/02; F25D 2600/04; F25D 2700/12; F28D 2021/0029
USPC ..... 62/3.62
See application file for complete search history.

(56) References Cited

U.S. PATENT DOCUMENTS

| | | | | |
|---|---|---|---|---|
| 5,713,208 | A | 2/1998 | Chen | |
| 2009/0049845 | A1 | 2/2009 | McStravick | |
| 2010/0186423 | A1* | 7/2010 | Veltrop | F25B 21/04 62/3.6 |
| 2010/0307168 | A1* | 12/2010 | Kohl | F25B 21/02 62/3.6 |
| 2012/0017609 | A1* | 1/2012 | Voute | A61J 1/165 62/62 |

FOREIGN PATENT DOCUMENTS

| | | |
|---|---|---|
| DE | 3528731 | 3/1986 |
| GB | 2501223 | 10/2013 |
| WO | 199316667 | 9/1993 |
| WO | 200102268 | 1/2001 |

* cited by examiner

PORTABLE TEMPERATURE CONTROLLED CONTAINER

TECHNICAL FIELD

This invention relates to a portable temperature controlled container. More specifically, the present invention relates to a portable temperature controlled container for transportation of highly-temperature-sensitive goods such as pharmaceuticals and vaccines.

BACKGROUND ART

The transportation of highly-temperature-sensitive pharmaceuticals and vaccines (hereinafter simply referred to as goods) is a major problem facing the distributers of those goods and the healthcare workers charged with administering those goods. If these goods are subjected to a temperature outside their acceptable temperature storage range, even for a short period of time, the goods will spoil. In some instances, spoiling will result in the goods being less effective than would otherwise be the case and in other instances, the goods may become dangerous to administer and they may represent a significant health risk to the intended recipient. Accordingly, it is essential that the distributers of the goods ensure that the goods are maintained within the desired temperature range from the time of production to the time of administration.

Once produced and prior to distribution to remote locations, the goods are stored at a central hub in an environmentally-controlled warehouse facility. In some cases, the goods are transported in environmentally-controlled vehicles to regional hubs where the goods are again stored in an environmentally-controlled warehouse facility before distribution. This part of the distribution chain is not seen as problematic. Of particular concern is the so-called "last mile" of the distribution chain where the goods are transported from a temperature-controlled facility to the location that they are to be administered. It is absolutely essential that the goods are maintained within their desired temperature range over the so-called "last mile". In order to protect the goods over the last mile, they are often transported in portable temperature controlled containers.

The known temperature controlled containers typically comprise an insulated box constructed from polystyrene or other insulating material. The goods are carefully placed inside the box and the box is then often packed with ice (in hot climates) to keep the goods inside the insulated box cool. The goods are then transported over the "last mile" to the intended destination.

There are however, numerous problems with this solution. First of all, the temperature at which the goods are stored is not accurately controlled and there is no guarantee that the goods will be maintained within the desired temperature range. Secondly, it is difficult to determine precisely how much ice will be required for a given journey. If too much ice is packed into the container, the goods may freeze thereby spoiling the goods. On the other hand, if too little ice is packed into the container, the ice may have melted before the goods have been delivered and the goods may spoil prior to delivery. Thirdly, in some instances, the location will be very remote and may take several days to reach. In those instances it would be necessary to restock the ice on one or more occasions during the journey but this is often not possible. Furthermore, in those instances where the location is very remote, the container may experience significant variations in ambient temperature over the course of the journey, from extreme heat to extreme cold, and this is not addressed by the proposed solution.

There are however more complex solutions that involve the use of electromechanical systems to control the temperature of the goods in the portable container over the last mile. Electromechanical systems for refrigeration have existed for many years and while relatively efficient, they suffer from two main drawbacks. First of all, these systems are not considered to be particularly robust which makes it difficult for such systems to be reliable when exposed to the mechanical stresses experienced during journeys over rough terrain. Secondly, battery power must be relied upon and it is challenging to design lightweight, cost effective devices that will keep small quantities of product at correct temperatures for complete journey times. Generally speaking, many of the known designs that use electromechanical systems are too complex and therefore too expensive for the so-called "last mile" application addressed by this invention.

One device that has been proposed that attempts to address some of these problems is the device described in Chinese Patent Application No. CN103075856 in the name of Shanghai Polytechnic University. This device proposes to use a semiconductor cooling system and insulation comprising copper tubes filed with a phase changing material that will keep the contents cool when the semiconductor cooling system is not operational. Another device known to the applicant is GB2501223 in the name of Mars Incorporated. GB2501223 describes a cool storage cabinet used for storing chocolate in hot climates that has a thermoelectric cooling device and a phase change material. The phase change material is used to keep the contents of the cabinet cool during power outages when the thermoelectric cooling device is not operational.

It is an object of the present invention to provide a portable temperature controlled container that overcomes at least some of the problems with the known devices. It is a further object of the present invention to provide a useful choice to the consumer.

SUMMARY OF INVENTION

According to the invention there is provided a portable temperature controlled container comprising:

- a body having an outer shell, an inner shell and an insulation layer therebetween, the body defining a storage compartment and an opening to permit access to the storage compartment;
- an insulated lid selectively covering the opening in the body;
- a first thermoelectric device in thermal communication with the storage compartment;
- a first phase change material in thermal communication with the first thermoelectric device;
- a rechargeable battery;
- a temperature sensor operable to measure the temperature inside the storage compartment;
- a controller in communication with the thermoelectric device and the temperature sensor, the controller being operable to control the thermoelectric device to regulate the temperature inside the storage compartment; and in which
- the thermoelectric device is operable to remove energy in the form of heat from one of the storage compartment and the first phase change material and transfer that energy in the form of heat to the other of the storage compartment and the first phase change material.

By having such a portable temperature controlled container, it will be possible to maintain the temperature of the goods within a specific range, for substantial periods of time at a relatively low cost. This is achieved by having a thermoelectric device and a phase change material configured so that the thermoelectric device is operable to remove energy in the form of heat from one of the storage compartment and the first phase change material and transfer that energy in the form of heat to the other of the storage compartment and the first phase change material as required. This configuration has been found to significantly reduce the power requirement of the container thereby reducing the overall cost of the container and increasing the length of time that the goods may be safely stored in the container. Furthermore, due to the use of a thermoelectric device, the configuration described will be more robust than other known offerings.

In one embodiment of the invention there is provided a portable temperature controlled container in which the first thermoelectric device is operable to remove energy in the form of heat from the storage compartment and transfer that energy in the form of heat to the first phase change material.

In one embodiment of the invention there is provided a portable temperature controlled container in which there is provided a second thermoelectric device controlled by the controller, a heat sink in thermal communication with the second thermoelectric device, an air passageway through the body, and a fan operable to deliver airflow through the air passageway over the heat sink. An important advantage of this configuration of container is that once it arrives at the remote destination, if an alternative electricity supply is available, the thermoelectric devices may be operated from the alternative electricity supply so that the container may be operated as a normal mains powered unit, thereby obviating the need for a dedicated storage unit at the destination and prolonging the length of time that the goods may be stored in the container prior to being administered. Furthermore, by having the additional components, it will be possible to re-energise the phase change material without removing the phase change material from the container.

In one embodiment of the invention there is provided a portable temperature controlled container in which the first thermoelectric device is sandwiched between the storage compartment and the first phase change material and the second thermoelectric device is sandwiched between the first phase change material and the heat sink.

This is seen as a particularly preferred embodiment of the present invention. There are numerous benefits to providing this configuration. By having such a configuration, the first phase change material will act as a barrier insulating layer between the storage compartment and the heat sink. If the storage compartment is to be kept cool or indeed is to be regulated in a narrow temperature range, this is particularly advantageous as the heat sink could otherwise have a significant effect on the temperature in the storage compartment. Secondly, after a long journey has been completed, the phase change material can be recharged very quickly by operating the second thermoelectric devices and the excess heat can be dissipated through the heat sink with relative ease. At the same time, the temperature in the storage compartment can be regulated in the normal manner using the first thermoelectric device and the first phase change material.

In one embodiment of the invention there is provided a portable temperature controlled container in which the storage compartment, first thermoelectric device, first phase change material, second thermoelectric device and heat sink are arranged in a stack configuration with the storage compartment located at the top of the stack, the first thermoelectric device located immediately below the storage compartment, the first phase change material located immediately below the first thermoelectric device, the second thermoelectric device located immediately below the first phase change material and the heat sink located immediately below the second thermoelectric device, at the bottom of the stack.

In one embodiment of the invention there is provided a portable temperature controlled container in which there is provided a heating element controlled by the controller in thermal communication with the storage compartment.

This is seen as another particularly useful embodiment of the present invention. By having a heating element in thermal communication with the storage compartment, the first phase change material can be used to absorb excess heat delivered from the storage compartment by the first thermoelectric device and the heating element can be used to deliver heat to the storage compartment if required. This will save having to provide a second phase change material to provide heat to the storage compartment if it is required. It has been found that the amount of energy typically required to heat the storage compartment is less than the energy required to cool the storage compartment during the expected operating conditions of the device. Therefore, if a heating element is provided, it will not require significant amounts of battery power to operate and will allow for more phase change material used in cooling of the storage compartment. This will lead to a container that can transport the goods for longer between charging operations.

In one embodiment of the invention there is provided a portable temperature controlled container in which the second thermoelectric device is sandwiched between the first phase change material and the heat sink, and the first thermoelectric device is sandwiched between the storage compartment and the heat sink, the first thermoelectric device being in thermal communication with the first phase change material via the heat sink and the second thermoelectric device. Again, this configuration will allow the phase change material to be recharged (i.e. refrozen) in a fast, efficient manner.

In one embodiment of the invention there is provided a portable temperature controlled container in which there is provided: a third thermoelectric device controlled by the controller in thermal communication with the heat sink, a second phase change material in thermal communication with the third thermoelectric device, the first thermoelectric device being in thermal communication with the second phase change material via the heat sink and the third thermoelectric device.

This is seen as a useful embodiment of the present invention. By having a second phase change material and a third thermoelectric device, one of the phase change materials can be used to cool the storage compartment and the other phase change material can be used to heat the storage compartment. In this way, the container will be able to regulate the temperature of the goods inside the container in both extreme hot and extreme cold conditions without drawing large amounts of power from the battery. This will provide a device that can operate efficiently across a wider range of environmental conditions in a cost effective manner. Furthermore, with this configuration, it will be possible to restore the properties of both of the phase change materials in a fast, efficient manner once the device is connected to a mains supply after use.

In one embodiment of the invention there is provided a portable temperature controlled container in which the first thermoelectric device is sandwiched between the storage compartment and the first phase change material and the second thermoelectric device is sandwiched between the storage compartment and the heat sink. This is seen as a further useful alternative embodiment of the present invention.

In one embodiment of the invention there is provided a portable temperature controlled container in which there is provided: a third thermoelectric device controlled by the controller in thermal communication with the storage compartment, and a second phase change material in thermal communication with the third thermoelectric device, and in which the first thermoelectric device is operable to remove energy in the form of heat from the storage compartment and transfer that energy in the form of heat to the first phase change material and in which the third thermoelectric device is operable to remove energy in the form of heat from the second phase change material and transfer that energy in the form of heat to the storage compartment.

Again, this is seen as a useful embodiment of the present invention. By having a second phase change material and a third thermoelectric device, one of the phase change materials will be used to cool the storage compartment and the other phase change material will be used to heat the storage compartment. In this way, the container will be able to regulate the temperature of the goods inside the container in both extreme hot and extreme cold conditions without drawing large amounts of power from the battery.

This will provide a device that can operate efficiently across a wider range of environmental conditions in a cost effective manner.

In one embodiment of the invention there is provided a portable temperature controlled container in which the second phase change material undergoes a solid to liquid phase transition upon heating of the second phase change material.

In one embodiment of the invention there is provided a portable temperature controlled container in which the second phase change material has a phase transition temperature within 4° C. of the phase transition temperature of the first phase change material.

In one embodiment of the invention there is provided a portable temperature controlled container in which the second phase change material comprises a eutectic composition.

In one embodiment of the invention there is provided a portable temperature controlled container in which the second phase change material is water.

In one embodiment of the invention there is provided a portable temperature controlled container in which the first phase change material undergoes a liquid to solid phase transition upon cooling of that phase change material.

In one embodiment of the invention there is provided a portable temperature controlled container in which the first phase change material has a phase transition temperature of between −2° C. and 8° C.

In one embodiment of the invention there is provided a portable temperature controlled container in which the first phase change material has a phase transition temperature of 0° C.

In one embodiment of the invention there is provided a portable temperature controlled container in which the first phase change material is water.

In one embodiment of the invention there is provided a portable temperature controlled container in which the first phase change material is a eutectic composition.

In one embodiment of the invention there is provided a portable temperature controlled container in which the thermoelectric device is a peltier device. A peltier device is seen a particularly suitable device due to the robustness of the device and furthermore due to the fact that the device may be operated to either provide heat to or cool the contents of the container.

In one embodiment of the invention there is provided a portable temperature controlled container in which the insulation layer comprises a vacuum insulation panel. Vacuum insulation panel is seen as a very useful insulation to use with the container as it will be relatively compact compared with other solutions and is capable of providing excellent insulation performance. Furthermore, this will help to allow a smaller battery to be provided in the container. The vacuum insulation panel could be a Nanopore (Registered Trade Mark®) vacuum insulation panel.

In one embodiment of the invention there is provided a portable temperature controlled container in which the insulation layer has a thermal conductivity value of the order of 0.005 W/m·K.

In one embodiment of the invention there is provided a portable temperature controlled container in which there is provided a heat transfer block intermediate the first phase change material and the thermoelectric device in thermal communication therewith. By providing a heat transfer block intermediate the phase change material and the thermoelectric device, this will enable insulation to be packed around the storage compartment ensuring better insulation of that compartment.

In one embodiment of the invention there is provided a portable temperature controlled container in which there is provided a heat transfer block intermediate the second phase change material and the thermoelectric device in thermal communication therewith.

In one embodiment of the invention there is provided a portable temperature controlled container in which the storage compartment has a volume of between 10 and 20 litres.

BRIEF DESCRIPTION OF THE DRAWINGS

The invention will now be more clearly understood from the following description of some embodiments thereof given by way of example only with reference to the accompanying drawings, in which.

DETAILED DESCRIPTION OF THE DRAWINGS

Figure 1:
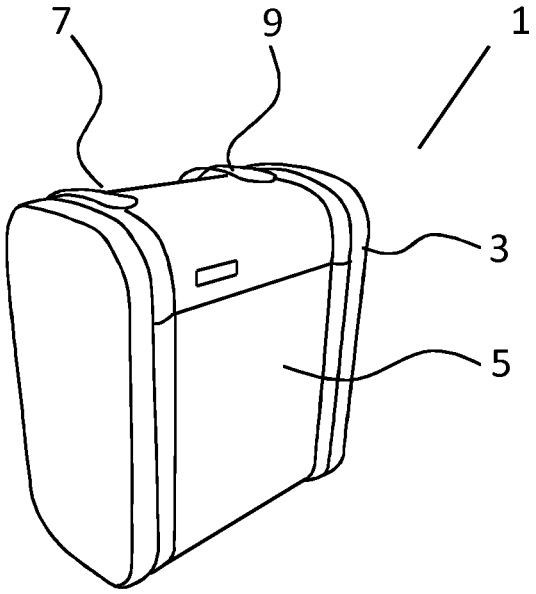
FIG. 1 is a perspective view of a portable temperature controlled container according to the invention.
Figure 2:
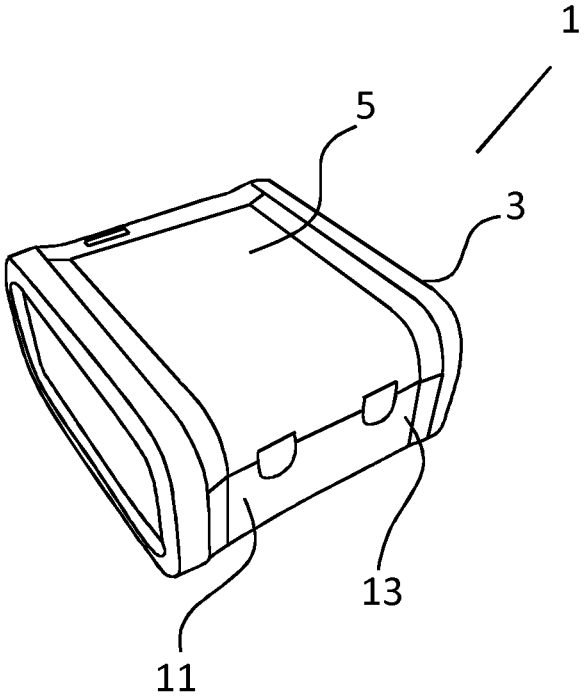
FIG. 2 is another perspective view of the portable temperature controlled container of FIG. 1.
Figure 3:
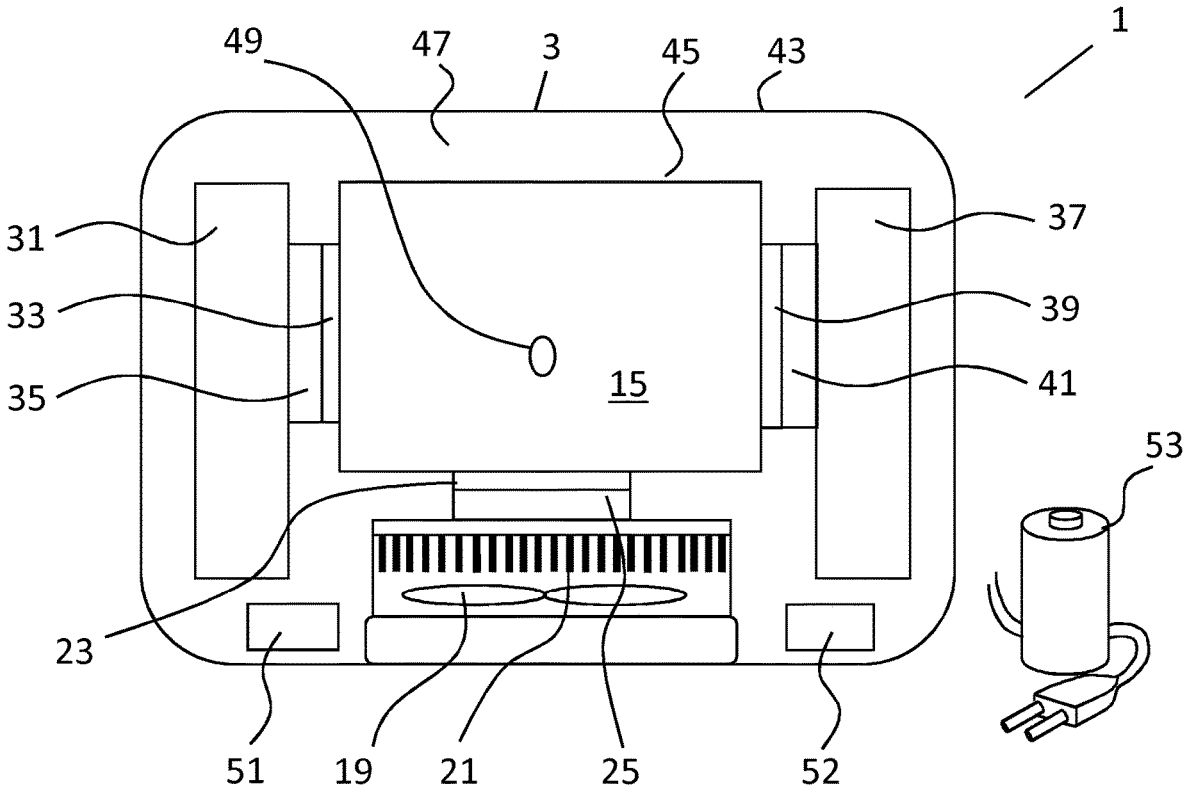
FIG. 3 is a diagrammatic representation showing the internal components of a portable temperature controlled container being prepared for shipping according to the invention.

Referring to FIGS. 1 and 2, there is shown a portable temperature controlled container, indicated generally by the reference numeral 1, comprising an insulated body 3 defining an opening (not shown) and an insulated lid 5 covering the opening in the body. A pair of straps 7, 9 are provided to allow the container to be carried on a wearer's back and/or to allow the container to be secured in place during transit. A charging socket 11 is formed in the body of the casing to allow charging of a rechargeable battery (not shown) and a data port 13 in the body is provided to allow for communication with a programmable controller (not shown) inside the container.

Referring to FIGS. 3 to 7 inclusive, there are shown diagrammatic representations of the portable temperature controlled container 1 showing the internal configuration of the container. The container body 3 defines a storage compartment 15 for storage of medicaments including highly temperature sensitive pharmaceuticals and vaccines. The container comprises a fan 19, a heat sink 21 and a thermoelectric device, in this case a peltier device 23. There is further provided a heat transfer block 25 intermediate the peltier device 23 and the heat sink 21. The peltier device 23 is in thermal communication with the storage compartment 15 and also with the heat sink 21 via the heat transfer block 25.

The container 1 further comprises a first phase change material 31, a thermoelectric device, again provided by way of a peltier device 33, and a heat transfer block 35 intermediate the peltier device 33 and the phase change material 31. The peltier device 33 is in thermal communication with the storage compartment and the first phase change material 31. There is further provided a second phase change material 37, a thermoelectric device, again provided by a peltier device 39, and a heat transfer block 41 intermediate the peltier device 39 and the second phase change material 37. The peltier device 39 is in thermal communication with the storage compartment and the second phase change material 37.

The container 1 body 3 comprises an outer shell 43, an inner shell 45, and an insulation layer 47 between the outer shell and the inner shell. The inner shell defines the storage compartment 15 which is effectively surrounded by the insulation layer 47. The insulation layer preferably comprises vacuum insulation panels (VIP) having a thermal conductivity value of the order of 0.005 W/m·K. There is further provided a temperature sensor 49 located internal the storage compartment 15, a rechargeable battery 51, and a controller 52 in communication with the temperature sensor 49 and operable to control the peltier devices 23, 33, 39.

In the embodiment shown, the first phase change material 31 undergoes a liquid to solid phase transition upon cooling of that phase change material and is operable to cool the storage compartment 15 as will be explained in greater detail below. In the embodiment shown, the first phase change material 31 undergoes the transition when cooled to approximately 4° C. The second phase change material 37 also undergoes a solid to liquid phase transition upon heating of that phase change material and is operable to heat the storage compartment, as will be explained in greater detail below. The second phase change material 37 undergoes the solid to liquid phase transition when heated to approximately 6° C. The first phase change material 31 and the second phase change material 37 do not have the same transition temperature and in some instances there will be a buffer zone of the order of approximately 1° C. to 4° C. between the two phase transition temperatures.

The operation of the device will now be explained in greater detail by reference to FIGS. 3 to 6 inclusive. In use, in FIG. 3, the device is prepared for shipping and is plugged into the mains supply 53. A voltage is applied across the peltier device 23. This has the effect of drawing heat from and by extension cooling the storage compartment 15. In many cases, the desired storage range of goods is of the order of 5° C. plus or minus a few degrees and for the purposes of this specification, it will be assumed that the desired temperature in the storage compartment will be 5° C. The heat extracted from the storage compartment 15 by the peltier device 23 is delivered to the heat sink 21. The heat is in turn removed to the external environment with the assistance of the fan 19. It will be understood that the peltier device 23, if operated in reverse with a voltage of opposite polarity across its terminals (not shown), would deliver heat from the external environment into the storage compartment 15.

While the peltier device 23, fan 19, heat sink 21, and heat transfer block 25 operate to cool the storage compartment 15, the peltier device 33 is operated to cool the first phase change material 31 below 4° C. thereby freezing the first phase change material 31 and if necessary the peltier device 39 is operated to heat the second phase change material above 6° C., thereby melting the second phase change material 37. It will be understood that temperature sensors may also be provided to measure the temperature of each of the first and second phase change materials 31 and 37 and this data will be delivered to the controller 52 so that the controller can operate the peltier devices 33, 39 appropriately. The internal rechargeable battery 51 is fully charged.

Figure 4:
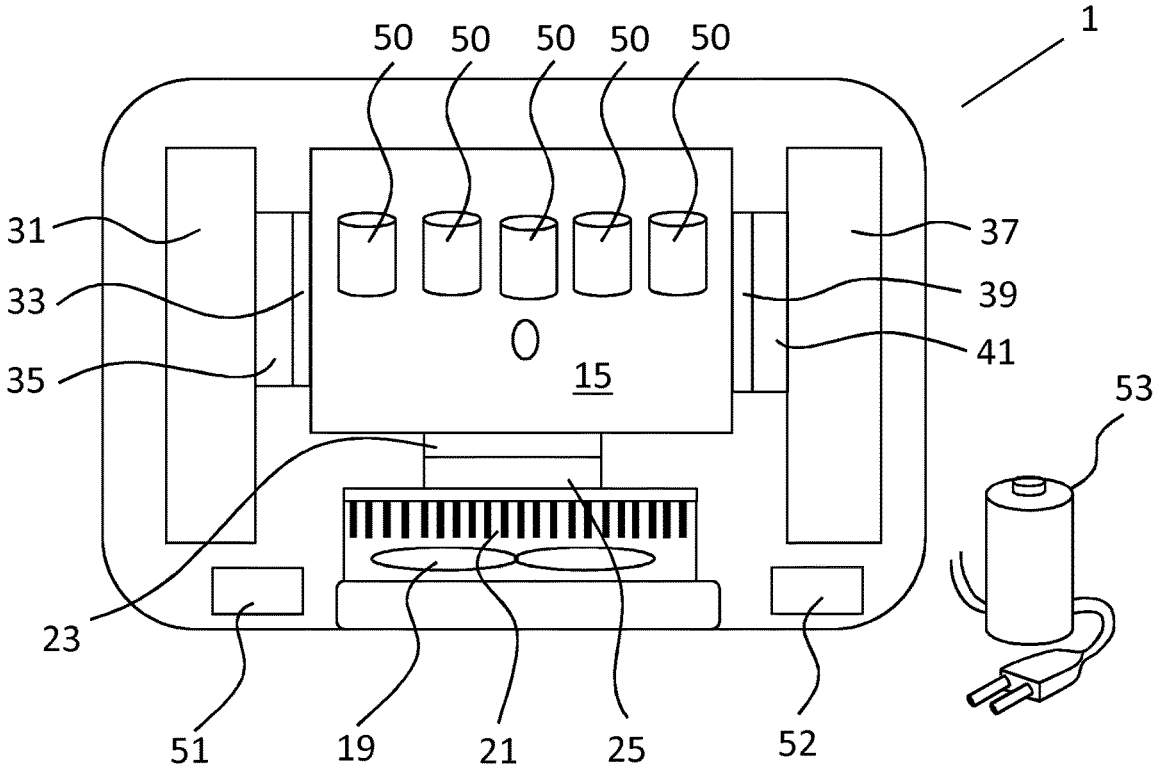
FIG. 4 is a diagrammatic representation of the portable temperature controlled container of FIG. 3 loaded and ready for shipping.

Referring to FIG. 4, the goods 50 are loaded into the storage compartment 15 ready for shipping. The controller operates the fan 19, the heat sink 21, the peltier device 23 and the heat transfer block 25 to maintain the temperature in the storage compartment 15 at or close to the desired temperature of 5° C. If necessary, the controller operates the peltier devices 33, 39 to maintain the first phase change material 31 in a solid state and the second phase change material 37 in a molten state.

Figure 5:
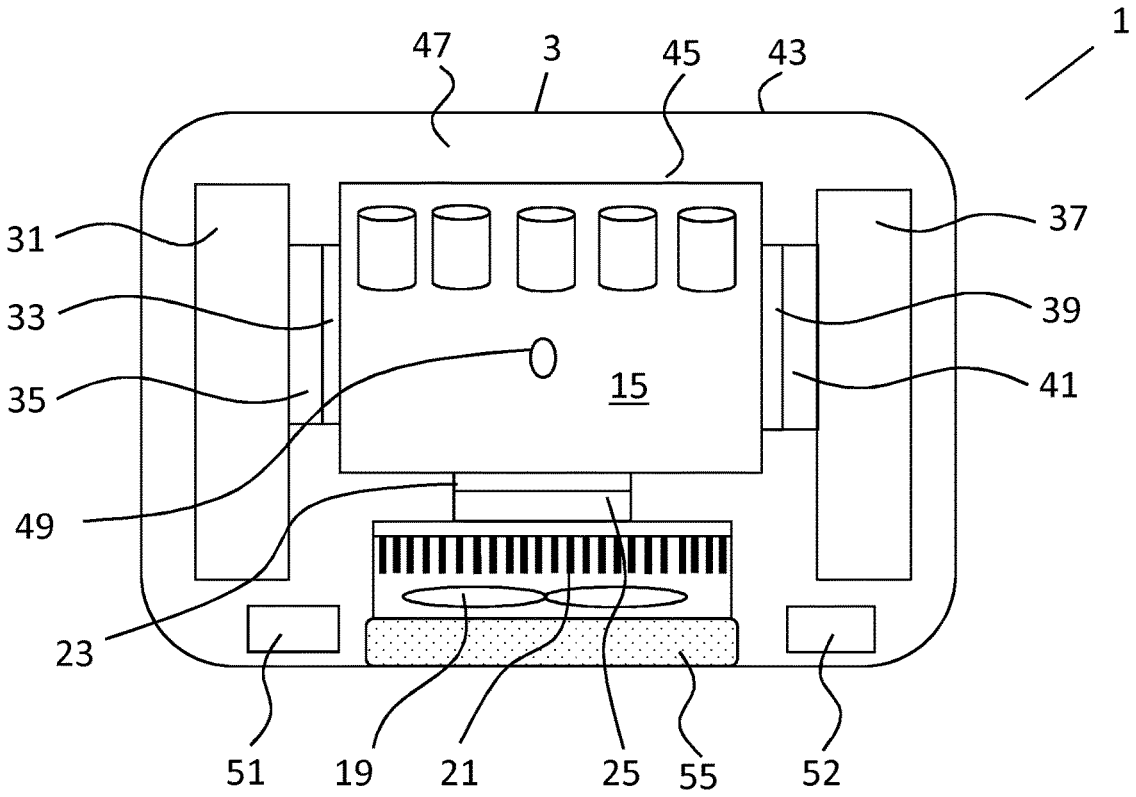
FIG. 5 is a diagrammatic representation of the portable temperature controlled container of FIG. 3 loaded and in transit.

Referring to FIG. 5, the container 1 is illustrated in transit. The container 1 has been disconnected from the mains supply and is powered by the rechargeable battery 51. An insulation plug 55 has been inserted into the container casing adjacent the fan 19 to improve the insulation of the container 1 during transit. The controller has turned off the fan 19, the heat sink 21, the peltier device 23 and the heat transfer block 25. Temperature regulation of the storage compartment is now carried out by the controller 52 operating one or both of the peltier devices 33, 39.

If the ambient conditions of the external environment are above the desired temperature of 5° C., this heat will cause the temperature inside the storage compartment 15 to rise over time, as recorded by the temperature sensor 49. In order to avoid the storage compartment overheating thereby spoiling the goods, the controller operates the peltier device 33 to transfer any excess heat away from the storage compartment 15 and into the frozen, solid phase change material 31 and maintain the temperature in the storage compartment at the desired temperature of 5° C. If the ambient conditions of the external environment are below the desired temperature of 5° C., this will cause the temperature inside the storage compartment to lower over time, as recorded by the temperature sensor 49. In order to avoid the storage compartment overcooling thereby spoiling the goods by allowing the goods to freeze, the controller operates the peltier device 39 to transfer heat stored in the molten phase change material 37 into the storage compartment and maintain the temperature in the storage compartment at the desired temperature of 5° C. In this mode, it is envisaged that there will be sufficient battery power to run the peltier devices and sufficient capacity in the phase change materials 31, 37 to maintain the temperature in the storage compartment at the desired temperature of 5° C. for at least 48 hours.

Figure 6:
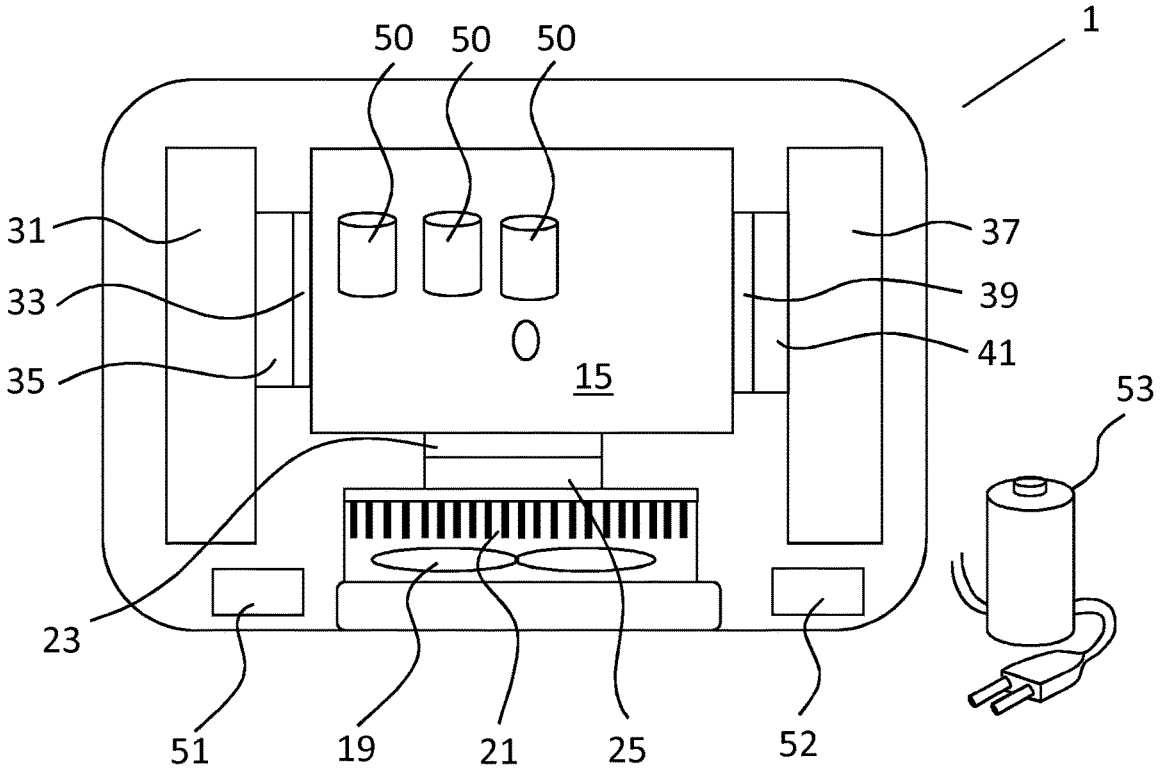
FIG. 6 is a diagrammatic representation of the portable temperature controlled container of FIG. 3 partially unloaded at its destination.

Referring to FIG. 6, the container 1 has reached the desired destination and some of the goods 50 have been removed from the storage compartment 15. The insulation plug 55 has been removed and the container 1 has been connected back up to the mains supply 53 once more. When connected to the mains supply, the controller 52 operates the fan 19, the heat sink 21, the peltier device 23 and the heat transfer block 25 to maintain the temperature in the storage compartment 15 at or close to the desired temperature of 5° C. The peltier devices 33, 39 are operated once more to store energy in the phase change materials 31, 37 respectively, if required. It can be seen therefore that a significant advantage of the present invention is that it is an "active" device and will be able to be used to refrigerate or heat the goods 50 after transportation in the remote location if there is no suitable storage unit available. All that is required is an external power supply which could be the mains supply or a supply provided by a generator or solar array, for example.

Figure 7:
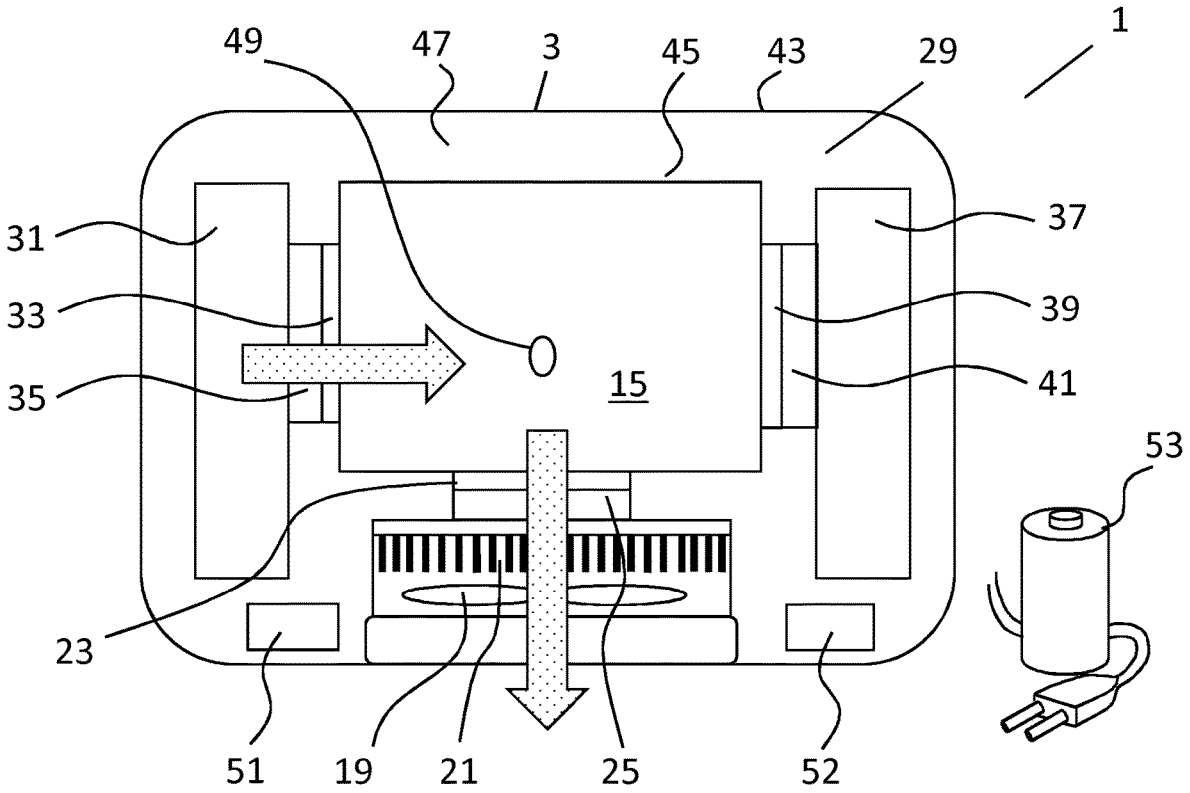
FIG. 7 is a diagrammatic representation of the portable temperature controlled container of FIG. 3 being prepared for shipping.

Referring to FIGS. 7 to 12 inclusive, there are shown representations similar to those shown in FIGS. 3 to 6 but with the addition of arrows illustrating the flow of heat and energy through the container 1. In FIG. 7, when the container 1 is being prepared to ship out following a hot journey, it will be necessary to freeze the first phase change material 31 as the energy stored in that phase change material 31 will have been depleted during the previous journey. The peltier 33 is operated to remove heat from the first phase change material 31 and deliver that heat into the storage compartment 15. From there, the heat is removed from the storage container by the operation of the fan 19, the heat sink 21, the peltier device 23 and the heat transfer block 25. The fan 19, heat sink 21, peltier device 23 and heat transfer block 25 will be operated by the controller 52 in such a fashion to remove the heat delivered into the storage compartment 15 by the peltier device 33 and to lower the temperature in the storage compartment 15 to the desired temperature of 5° C. In the embodiment shown, the container and components are operated so that the rate of energy transfer is 32 Watts. At such a rate of transfer, it is envisaged that it would take approximately 2.4 hours to refreeze a fully depleted phase change material 31. However, it will be understood that this rate of transfer may be different and does not have to be 32 W and indeed the time taken to refreeze the phase change material may be different. In the embodiment shown, the ambient temperature outside the container is room temperature, 20° C., however the container may have experienced hotter temperatures during the previous journey.

Figure 8:
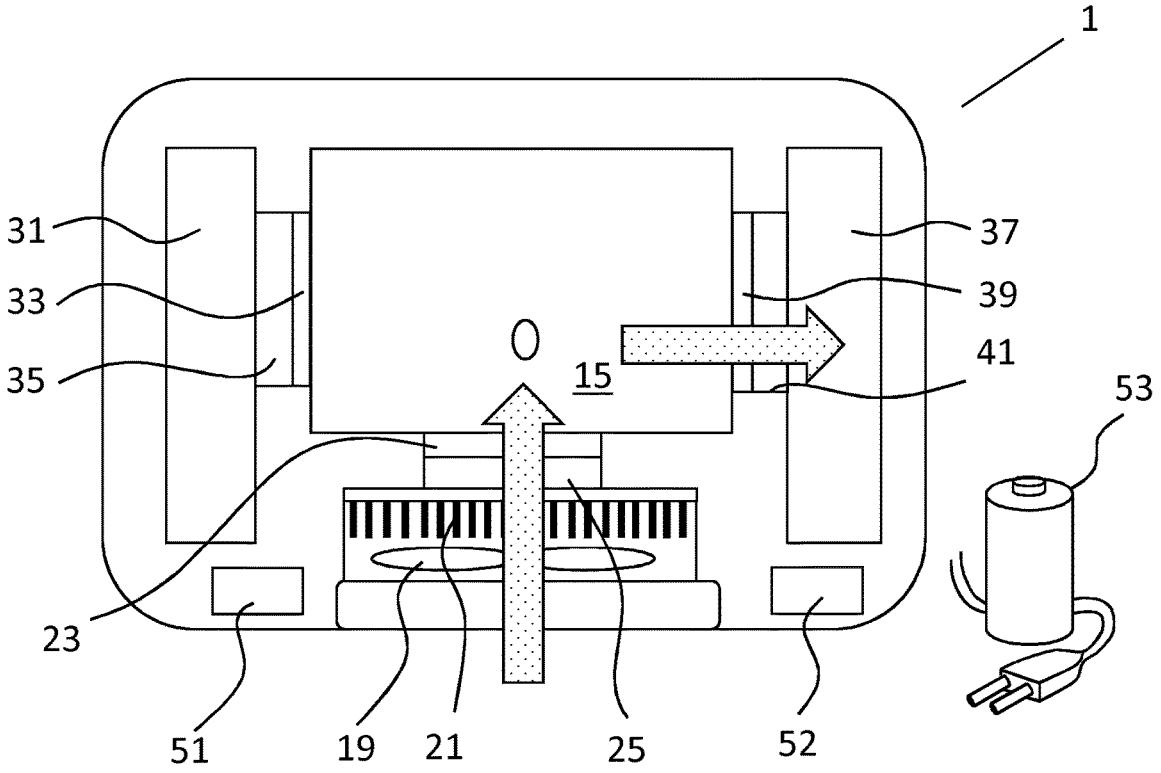
FIG. 8 is a diagrammatic representation of the portable temperature controlled container of FIG. 3 being prepared for shipping.

In FIG. 8, when the device is being prepared to ship out following a cold journey, it will be necessary to return the second phase change material 37 to a molten state as the energy stored in that phase change material 37 will have been depleted during the previous journey. Even if the second phase change material has not solidified, it will be necessary to store as much energy as possible therein. The peltier 39 is operated to provide heat to the second phase change material 37 by drawing heat from the storage compartment. Heat is provided to the storage compartment 15 by the operation of the fan 19, the heat sink 21, the peltier device 23 and the heat transfer block 25. The peltier device 23 is operated in the opposite orientation to that described in relation to FIG. 7 in that now it is providing heat into the storage compartment. The fan 19, heat sink 21, peltier device 23 and heat transfer block 25 will be operated by the controller in such a fashion to provide sufficient heat into the storage compartment 15 for onward delivery to the second phase change material 37 by the peltier device 39 and to regulate the temperature in the storage compartment 15 to the desired temperature of 5° C. In the embodiments shown, the container and components are operated so that the rate of energy transfer is 32 Watts. At such a rate of transfer, it is envisaged that it would take approximately 1.2 hours to melt a solid, fully depleted second phase change material 37. However, it will be understood that this rate of transfer may be different and does not have to be 32 W and indeed the time taken to melt the second phase change material may be different. In the embodiment shown, the ambient temperature outside the container is room temperature, 20° C., however the container may have experienced far colder temperatures during the previous journey.

Figure 9:
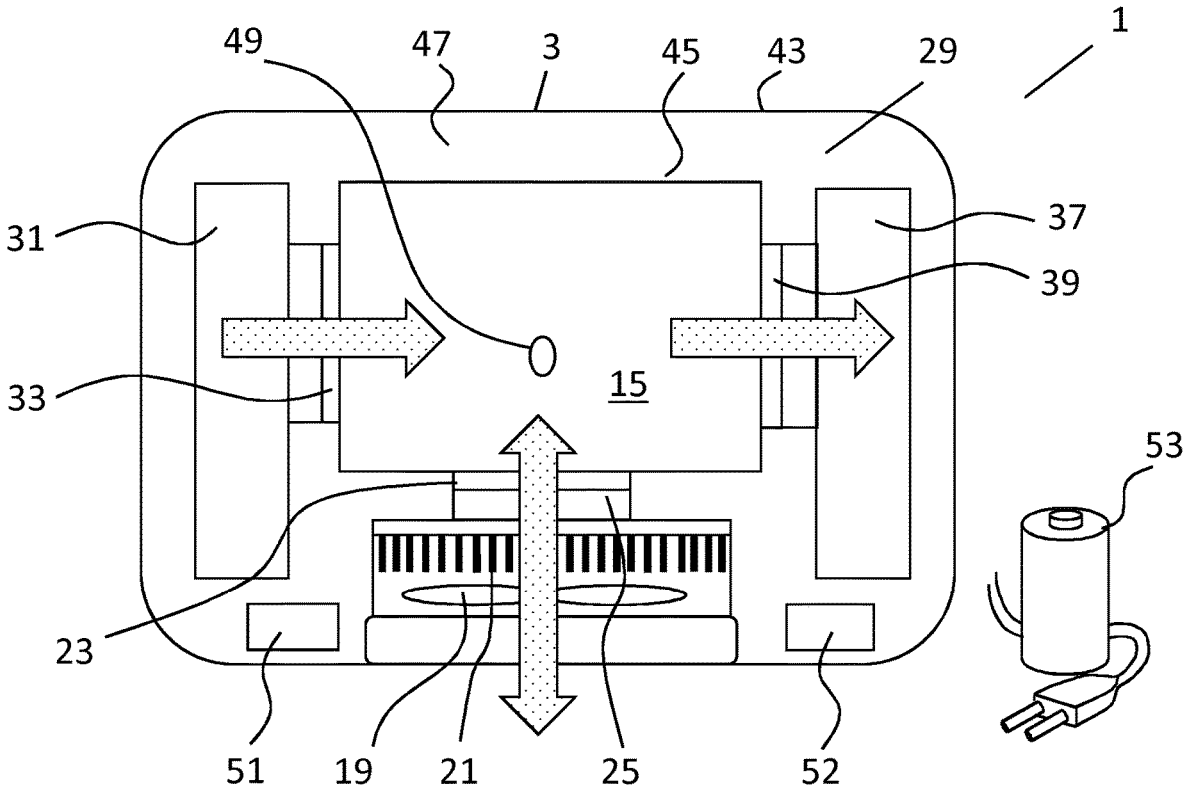
FIG. 9 is a diagrammatic representation of the portable temperature controlled container of FIG. 3 being prepared for shipping.

Referring to FIG. 9, when the device is being prepared to ship out following a journey during which the container experienced both hot and cold conditions, it will be necessary to return the first phase change material to a frozen state and the second phase change material 37 to a molten state as the energy stored in both phase change materials 31, 37 will have been depleted during the previous journey. The peltier device 33 is operated to remove heat from the first phase change material 31 and transfer that heat into the storage compartment 15 whereas the peltier device 39 is operated to provide heat to the second phase change material 37 by drawing heat from the storage compartment 15. The controller will operate the fan 19, the heat sink 21, the peltier device 23 and the heat transfer block 25 appropriately depending on which of the first and second phase change materials has been depleted the most in the previous journey and requires the most energy in order to get both phase change materials 31, 37 ready for the next journey.

It will be understood that to achieve this, the fan 19, heat sink 21, peltier device 23 and heat transfer block 25 will be operated by the controller (not shown) in such a fashion to either provide sufficient heat into the storage compartment for onward delivery to the second phase change material 37 by the peltier device 39 or to remove excess heat from the storage compartment 15 and from the first phase change material and to regulate the temperature in the storage compartment 15 to the desired temperature of 5° C. In the embodiments shown, the container 1 and components are operated so that the rate of energy transfer by the peltier device 33 is 32 Watts. In the embodiment shown, the ambient temperature outside the container is room temperature, 20° C., however the container may have experienced far hotter and colder temperatures during the previous journey.

Figure 10:
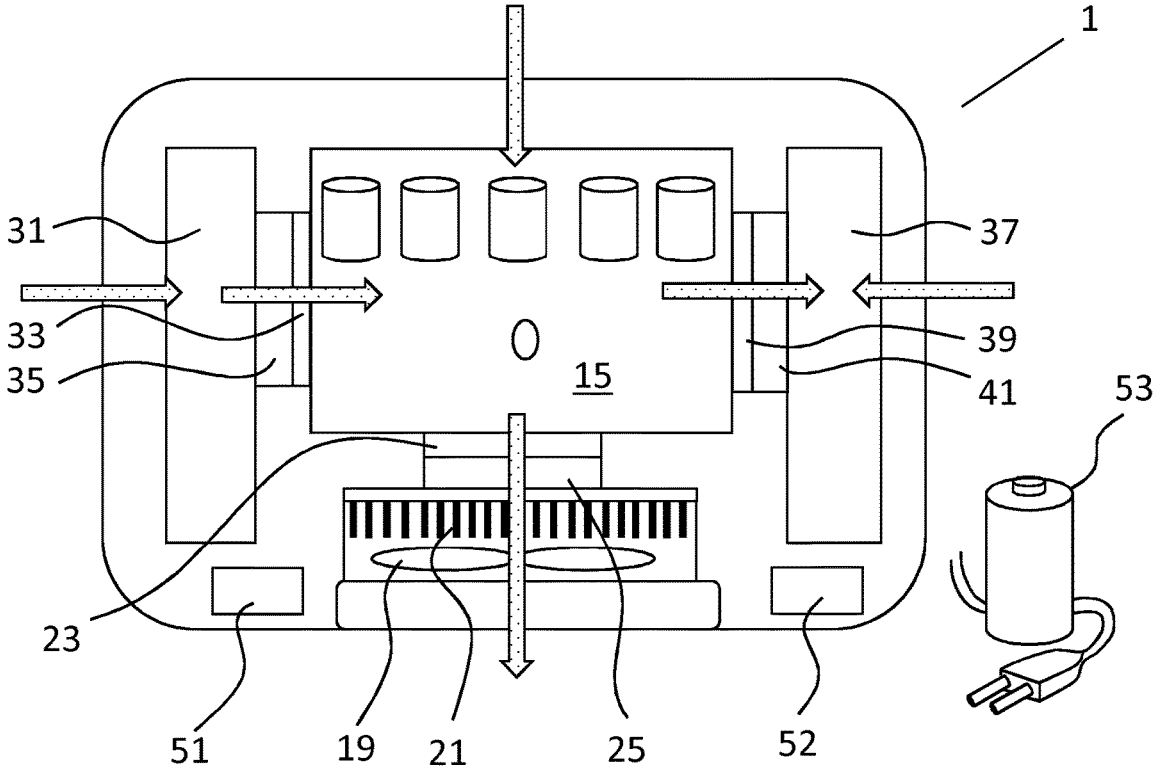
FIG. 10 is a diagrammatic representation of the portable temperature controlled container of FIG. 7 loaded and ready for shipping.

Referring to FIG. 10, the container has been prepared so that the temperature in the storage compartment is at the desired 5° C. The container is still plugged into the mains supply 53 and the peltier device 23 is operated to maintain the temperature in the storage compartment at the desired 5° C. The ambient temperature outside the container is at 20° C. It can be seen that there is a slight thermal transfer across the peltier device 33 from the first phase change material 31 and a slight thermal transfer across the peltier device 39 to the second phase change material 37. In this embodiment, the first phase change material is at a temperature of 3° C. whereas the second phase change material is at a temperature of 6° C.

Figure 11:
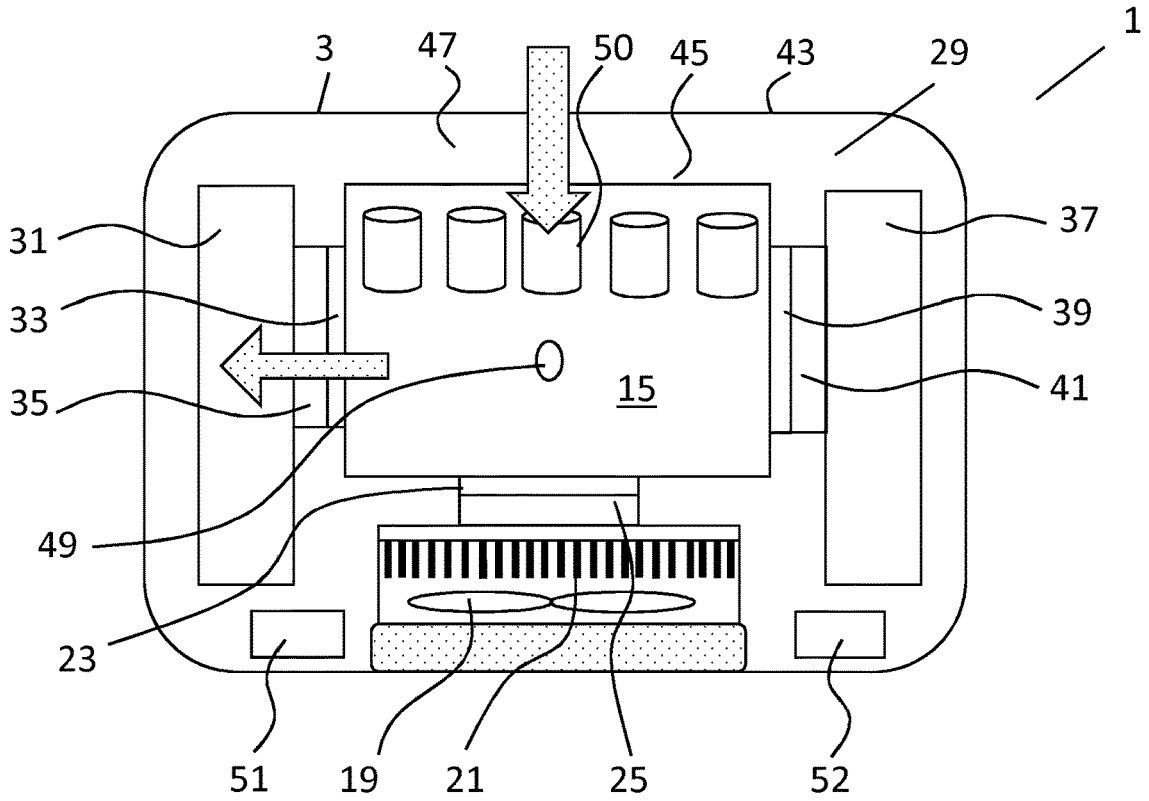
FIG. 11 is a diagrammatic representation of the portable temperature controlled container of FIG. 7 loaded and in transit.
Figure 12:
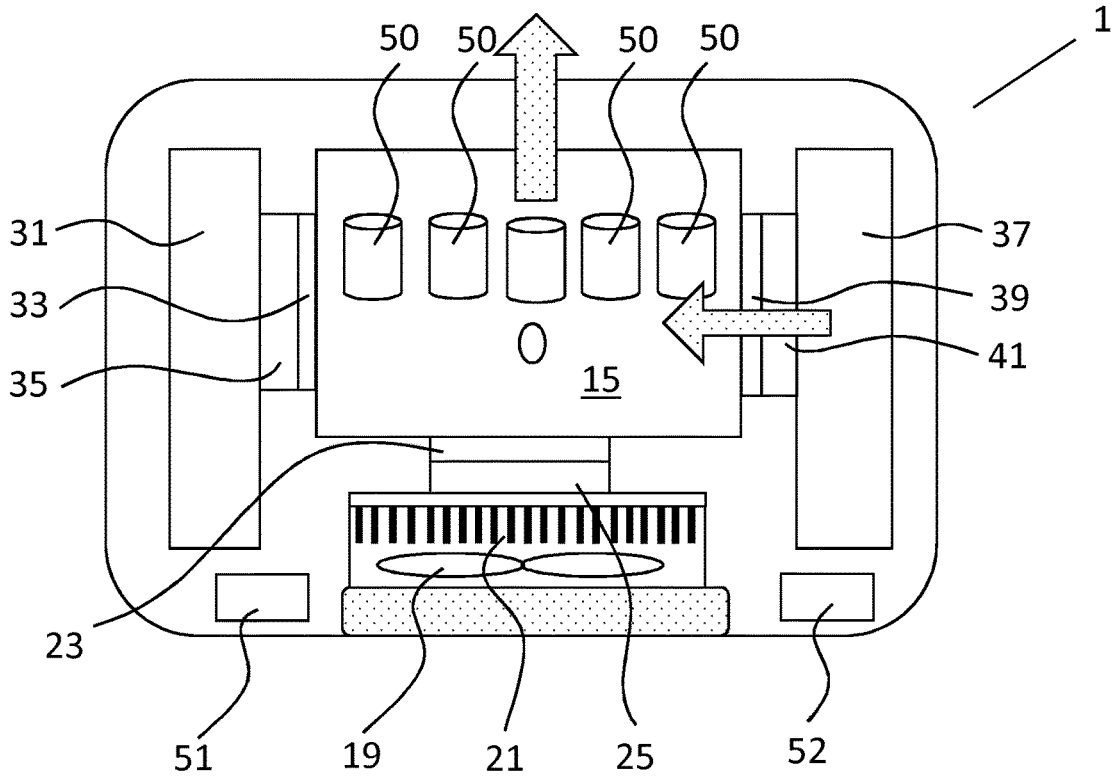
FIG. 12 is a diagrammatic representation of the portable temperature controlled container of FIG. 7 loaded and in transit.
Figure 13:
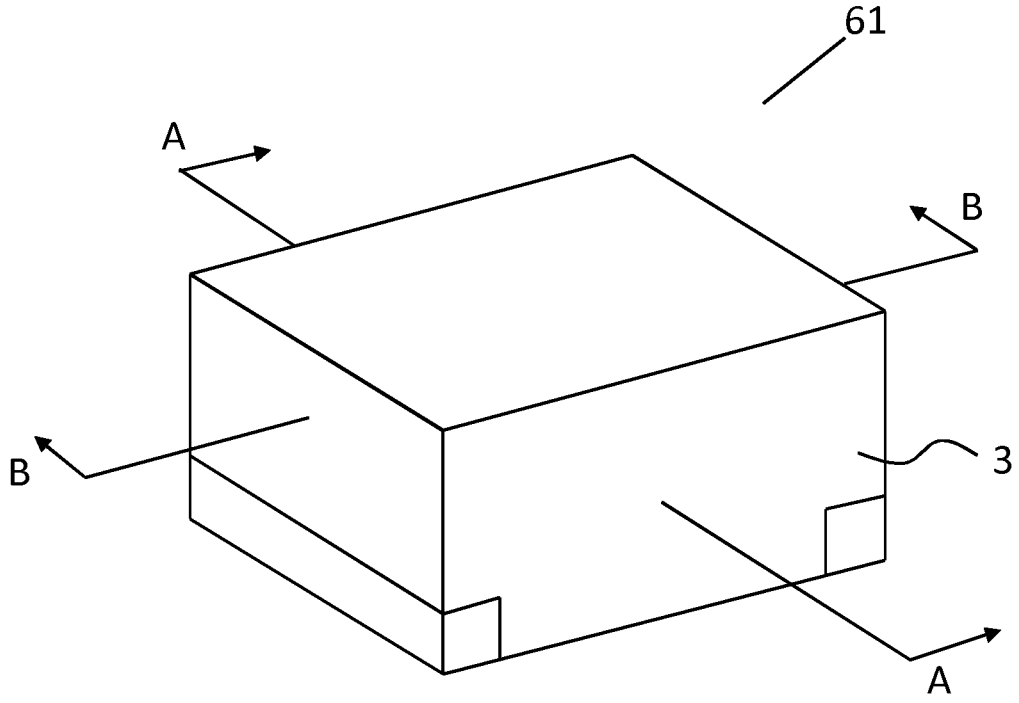
FIG. 13 is a diagrammatic representation of a second embodiment of portable temperature controlled container according to the invention.
Figure 14:
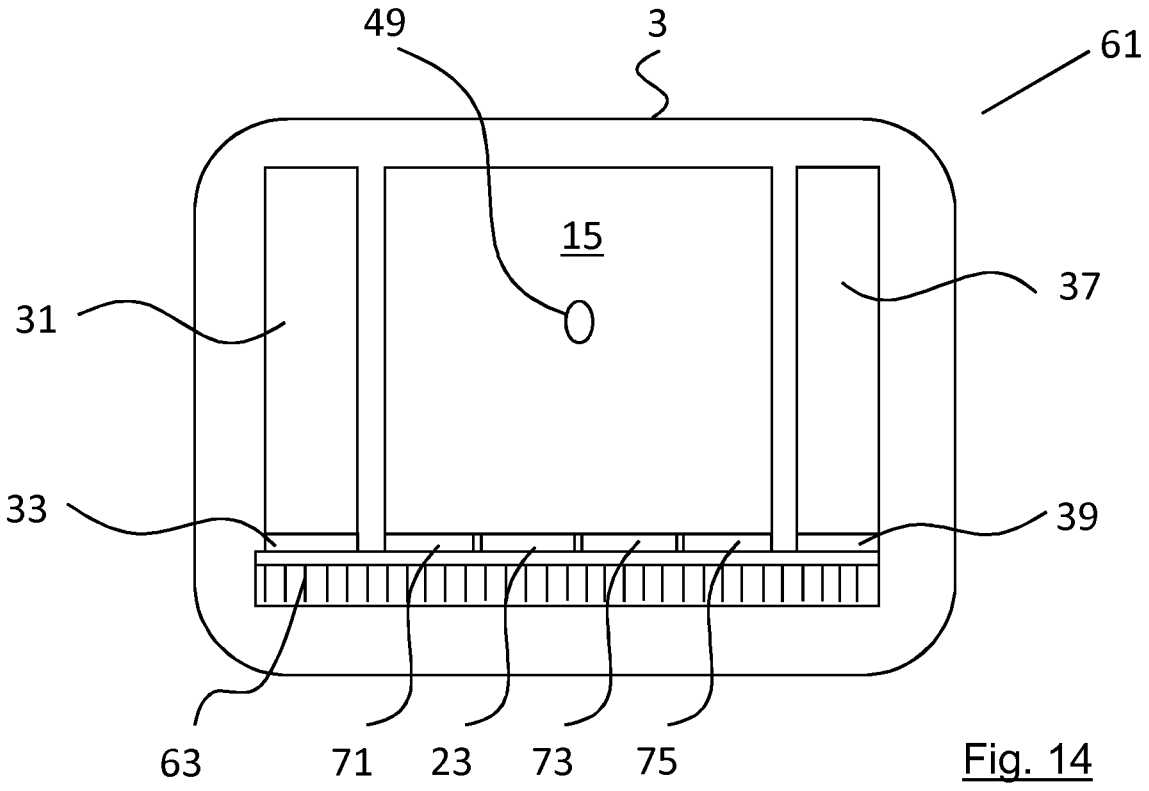
FIG. 14 is a cross-sectional view taken along the lines A-A of FIG. 13.

Referring to FIGS. 11 and 12 now, the container 1 is shown disconnected from the mains 53 and operating on the rechargeable battery 51. In FIG. 11, the container is being subjected to an external ambient temperature of 40° C. Based on the size of the container and the type of insulation used in the container, in the example shown, this is calculated to result in a transfer of heat from the exterior of the container across into the storage compartment 15 at a rate of 1.5 Watts. This heat is transferred out of the storage compartment 15 by the peltier device 33 being operated to transfer the heat from the storage compartment 15 to the first phase change material 31. In FIG. 12, the container 1 is being subjected to an external ambient temperature of −20° C. Based on the size of the container 1 and the type of insulation used in the container 1, in the example shown, this is calculated to result in a transfer of heat from the interior of the container 1 from the storage compartment 15 to the external environment outside the container at a rate of 1 Watt. This heat is replaced into the storage compartment 15 by the peltier device 39, powered by the rechargeable battery 51, being operated to transfer the heat from the second phase change material 37 into the storage compartment 15.

Figure 15:
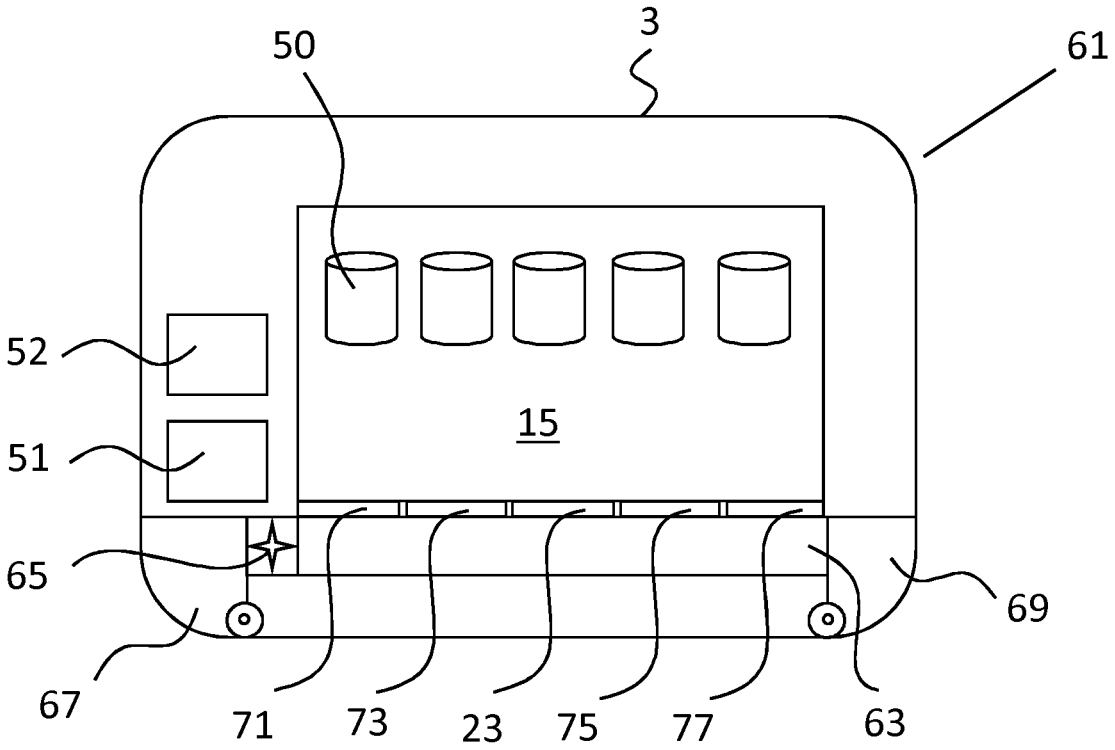
FIG. 15 is a cross-sectional view taken along the lines B-B of FIG. 13.
Figure 16:
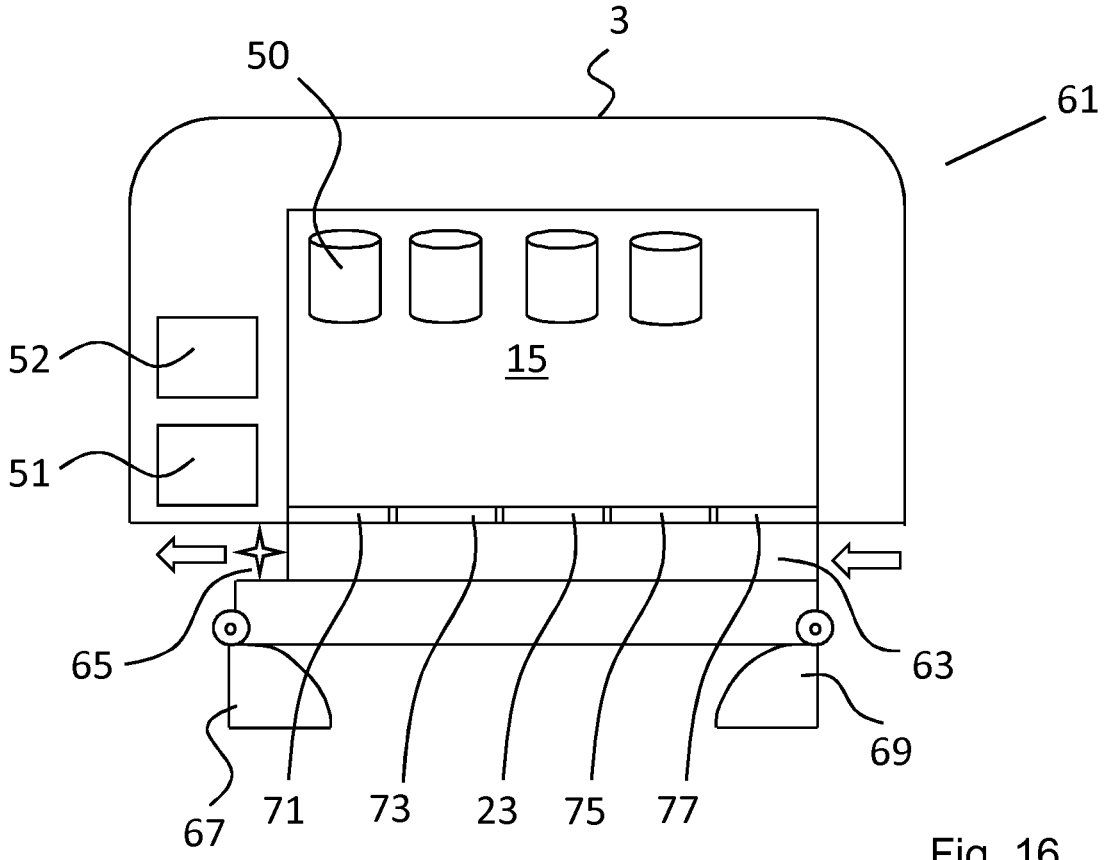
FIG. 16 is a cross-sectional view taken along the lines B-B of FIG. 13.
Figure 17:
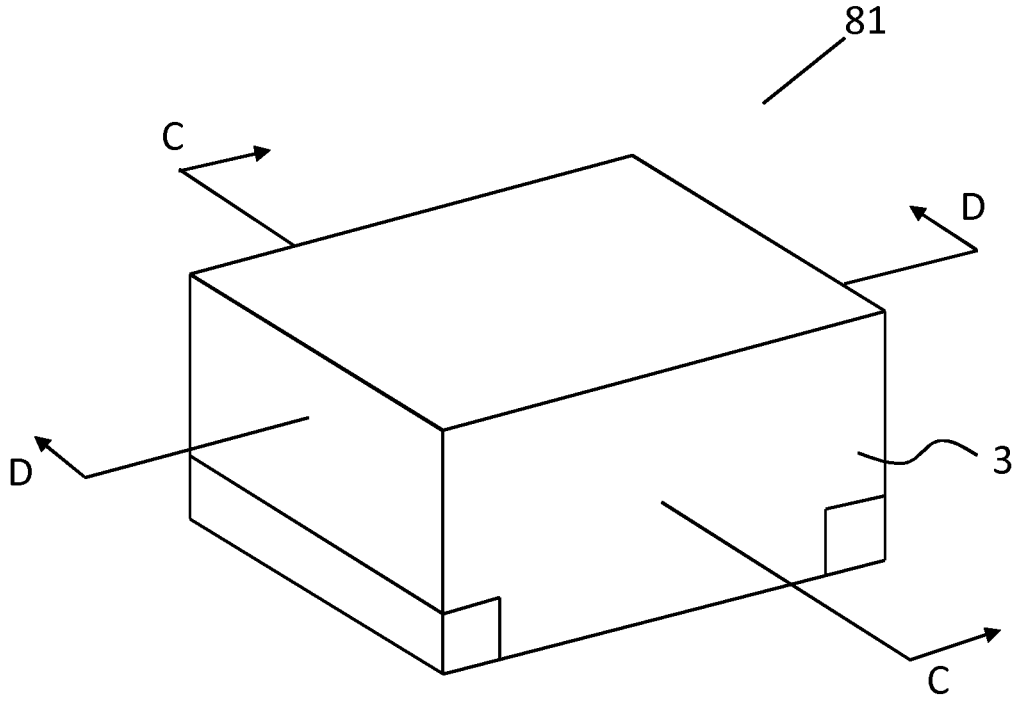
FIG. 17 is a diagrammatic representation of a third embodiment of portable temperature controlled container according to the invention.
Figure 18:
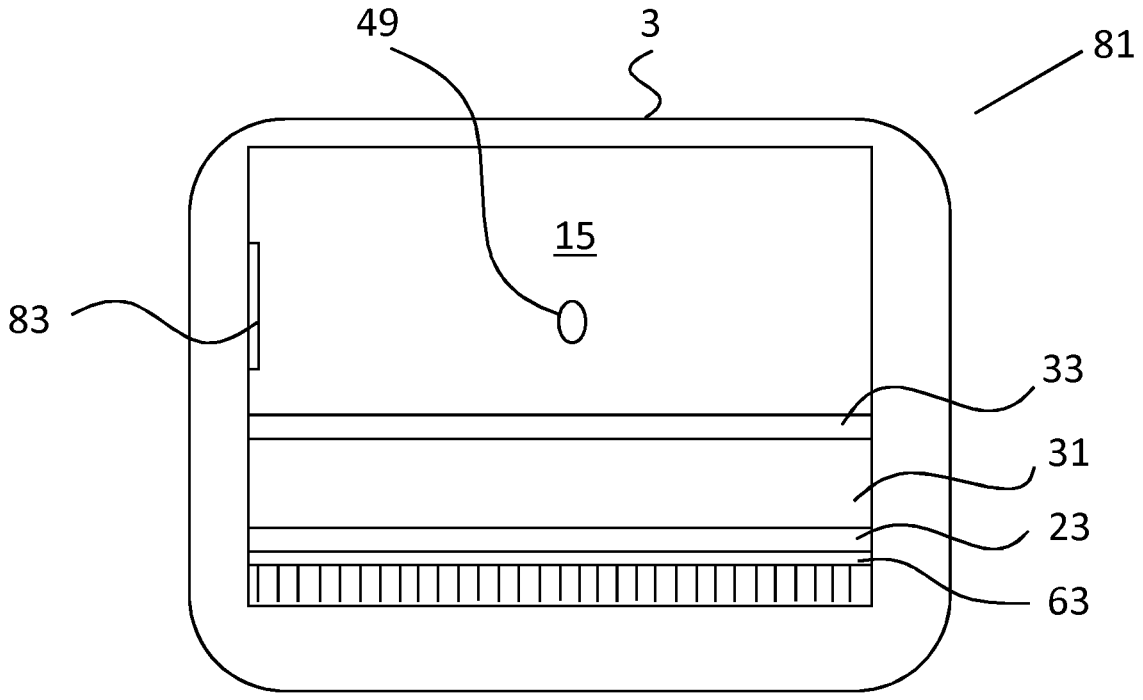
FIG. 18 is a cross-sectional view taken along the lines C-C of FIG. 17.
Figure 19:
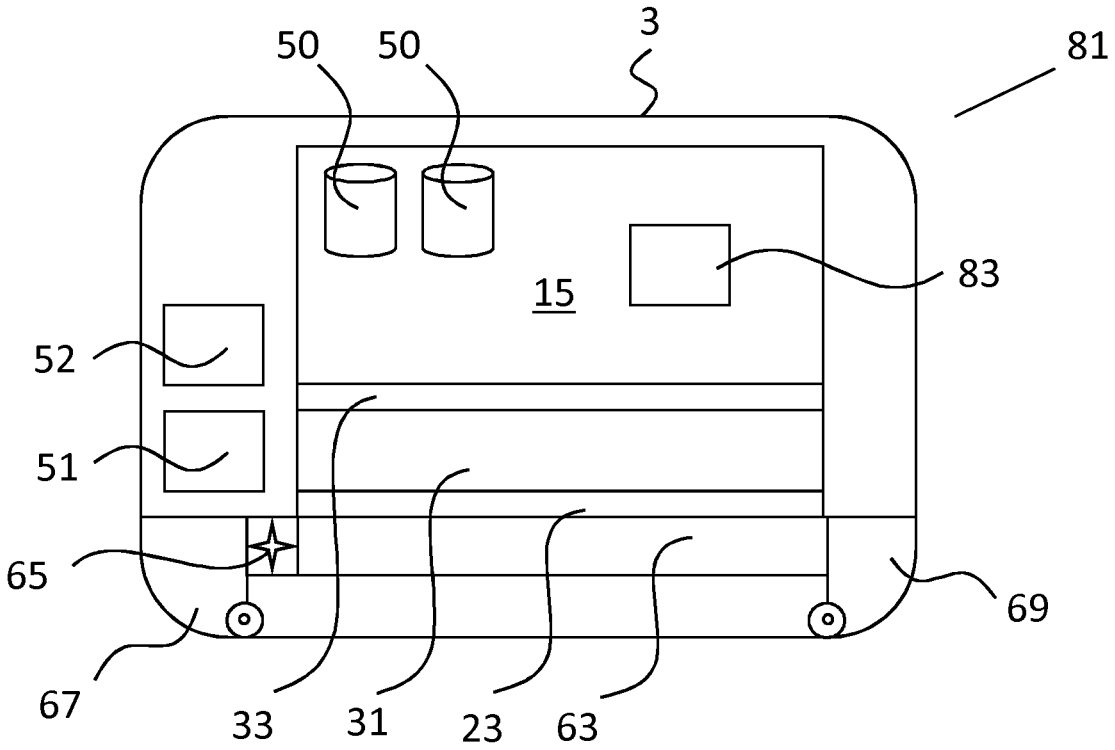
FIG. 19 is a cross-sectional view taken along the lines D-D of FIG. 17.
Figure 20:
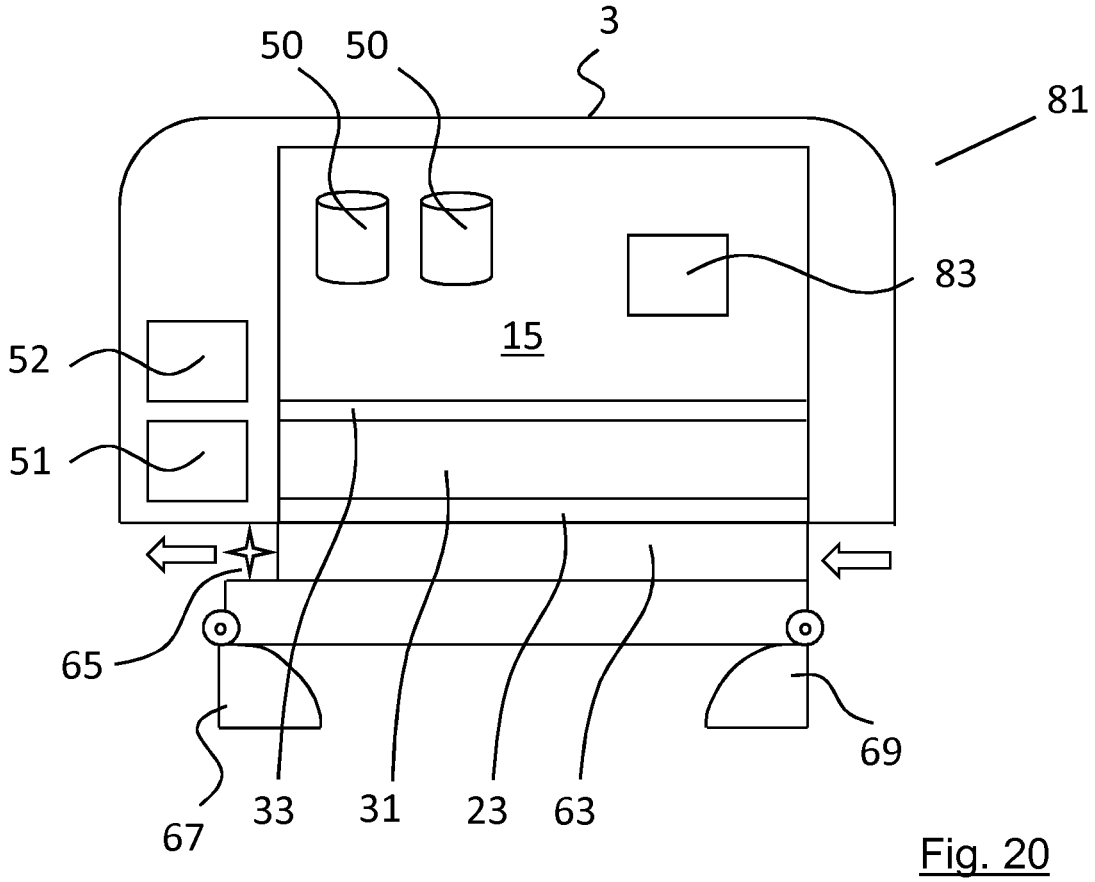
FIG. 20 is a cross-sectional view taken along the lines D-D of FIG. 17.

Referring now to FIGS. 13 to 16 inclusive, there is shown an a second embodiment of portable temperature controlled container, indicated generally by the reference numeral 61, where like parts have been given the same reference numeral as before. The portable temperature controlled container 61 differs from the portable temperature controlled container illustrated in previous embodiments in that in this variant, the storage compartment 15, the first phase change material 31 and the second phase change material 37 are all thermally connected via peltier elements 23, 33, 39 to a lower, communal heat sink 63 which spans the full length and width of the storage compartment 15 and phase change materials 31, 37. This lower heat sink 63 is then cooled by a long rotary fan 65 (as illustrated in FIGS. 15 and 16) which extends across the width of the heat sink 63. A pair of flaps, 67, 69 is provided in the insulated body 3, one at either end of the heat sink 63. By open two flaps 67, 69 on the lower side of the container 61, an air passageway is formed in the body in which the air intake and the air exhaust of the air passageway are well separated from each other leading to more effective cooling of the heat sink 63. It can further be seen that in this configuration with the flaps 67, 69 open (as illustrated in FIG. 16), the flaps 67, 69 can operate as feet upon which the container may be stood.

In the embodiment of portable temperature controlled container 61 shown in FIGS. 13 to 16, in order to cool the storage compartment 15, the first peltier device 23 is operated to remove heat from the storage compartment 15 and deliver that heat to the heat sink 63. The other peltier devices 71, 73, 75, 77 intermediate the heat sink 63 and the storage compartment 15 may also be operated if necessary however in order to keep the power requirement down, it is envisaged that only one peltier device will be operated in normal circumstances. The peltier device 33 will also be operated to remove heat from the heat sink and transfer that heat from the heat sink 63 into the phase change materials. If it is necessary to heat the storage compartment 15, the peltier device 39 will be operated to remove heat from the phase change material 37 and deliver that heat into the heat sink 63. From there, the heat may be transferred by the peltier device 23 operating in the opposite orientation to that described above to transfer the heat from the heat sink 63 into the storage compartment 15.

One benefit of this embodiment of the invention is that when the device is being "recharged", that is, when the first phase change material is being refrozen and the second phase change material is being melted, the heat does not have to pass through the storage compartment 15. This is beneficial for two reasons: First of all, the "recharge" time will be reduced. The peltier devices typically operate at about a 30% efficiency. In other words, it takes about 100 Watts of power to pump 30 Watts of heat. In the embodiment described with respect to FIGS. 1 to 12 inclusive, the extra 70 Watts has to be handled by the peltier device 23 attached to the storage compartment 15. In the alternative configuration shown in FIGS. 13 to 16, the excess 70 Watts is directly exhausted via the heat sink 63 and the fan 65. Secondly, the embodiment shown in FIGS. 13 to 16 has the advantage that it opens up the possibility that the device can still hold vaccine while in a powered "recharge" mode. If all the vaccine were not dispensed at destination 1, then the peltier devices 23, 71, 73, 75 could hold the temperature in the storage compartment 15 at 5° C. while the peltier 33 recharges the first phase change material 31 and the peltier 39 recharges the second phase change material 37 for a subsequent onward unpowered trip to the next destination.

In addition to the foregoing, in the embodiment shown in FIGS. 13 to 16, there are shown a plurality of peltier devices 23, 71, 73, 75 and 77 in communication with the storage compartment 15. More or less peltier devices could be connected intermediate the storage compartment and the heat sink 63. In addition to this, although there is only one peltier device 33, 39 respectively connected intermediate each of the phase change materials 31, 37 and the heat sink 63, more than one thermoelectric device could be provided intermediate either or both of the phase change materials 31, 37 and the heat sink 63. Furthermore, in this configuration, the peltier devices 23, 33, 39, 71, 73, 75 and 77 are all connected directly to one of the storage compartment 15, the first phase change material 31 and the second phase change material 37. However, one or more heat transfer blocks (not shown) could be provided if desired.

Referring now to FIGS. 17 to 20 inclusive, there is shown a third embodiment of portable temperature controlled container, indicated generally by the reference numeral 81, where like parts have been given the same reference numeral as before. The portable temperature controlled container 81 differs from the portable temperature controlled container 1, 61 illustrated in previous embodiments in that in this variant, the first thermoelectric device 33 is sandwiched between the storage compartment 15 and the first phase change material 31 and the second thermoelectric device 23 is sandwiched between the first phase change material 31 and the heat sink 63. Furthermore, there is provided a heating element 83 controlled by the controller 52 in thermal communication with the storage compartment 15.

The storage compartment 15, the first thermoelectric device 33, the first phase change material 31, the second thermoelectric device 23 and heat sink 63 are arranged in a stack configuration with the storage compartment 15 located at the top of the stack, the first thermoelectric device 33 located immediately below the storage compartment 15, the first phase change material 31 located immediately below the first thermoelectric device 33, the second thermoelectric device 23 located immediately below the first phase change material 31 and the heat sink 63 located immediately below the second thermoelectric device 33, at the bottom of the stack.

In use, the phase change material 31 is water that is converted into ice before transit. The water 31 is converted into ice by plugging the container into a mains electricity supply 53 and the controller 52 thereafter operating the peltier device 23 to freeze the water. The peltier device 23 will deliver the heat from the phase change material 31 into the heat sink 63 and the heat from the heat sink 63 will be dissipated to the environment with the aid of a fan 65. When the water 31 is frozen, the container 81 will be ready for use in the transportation of goods.

During transit, the storage compartment 15 is kept cool at the desired temperature by operating the peltier device 33 to transfer heat from the storage compartment 15 into the phase change material 31. In the embodiment shown, 4 litres of water are provided as the phase change material 31. It is calculated that this amount of phase change material will allow the container to maintain goods at 5° C. for at least 48 hours at a temperature of 43° C.

If it is necessary to provide heat to the storage compartment 15, rather than operating a peltier device and a separate phase change material as described in relation to the first two embodiments, the heating element 83 can be operated. It is believed that the battery 51 will provide sufficient power to operate the heating element 83 for the limited amount of time and current draw that it will need to operate. As the rate of exchange of energy out of the container at −20° C. is lower than the rate of exchange of energy into the container at 43° C., less energy will be required to heat the container. If the container is used to transfer goods through a desert or over mountains, it is not inconceivable that the container will experience both high and low temperatures during its journey. However, the highs tend to be more extreme than the lows compared with the desired storage temperature of the goods and therefore less energy is required to adjust for low temperature conditions than required to adjust for high temperature conditions.

Once at the destination, the phase change material can be replenished (i.e. refrozen) by plugging the container 81 into the mains electricity or other external supply once more and operating the peltier device 23 to cool the phase change material. It will be understood that the flaps 67, 69 will be opened and the fan 65 operated to dissipate heat from the heat sink caused by the operation of the thermoelectric (peltier) device 23.

One significant advantage of the configuration shown is that the phase change material may be refrozen quickly by operating the peltier device 23 at high power. This can be done as the peltier device will not adversely affect the temperature in the storage compartment 15 as the storage compartment 15 is insulated from the peltier device 23 by the layer of phase change material therebetween.

Another significant advantage of this embodiment is that the container 81 can continue to be used to store goods while plugged into the mains and while the phase change material 31 is being refrozen. The peltier device 33 can continue to operate feeding heat into the phase change material 31 while the other peltier device 23 operates (albeit typically at a faster rate) to cool the phase change material 31. Furthermore, as the replenishment or refreezing of the phase change material 31 does not require transition of energy through the storage compartment 15, goods can still be stored in the storage compartment.

A third advantage of the embodiment shown in FIGS. 17 to 20 is that the container 81 is well suited to working in both a mains supplied and a battery powered mode. Therefore, the container can be used to store the medicaments for prolonged periods of time without fear of the medicaments or other goods perishing.

In the embodiments shown, the container will be appropriately sized so that it can transport of the order of 10 litres worth of pharmaceuticals and/or vaccines. In order to provide an internal compartment that is capable of holding 10 litres worth of product, it is envisaged that the external dimensions of the container will be of order of 570 mm (long)×400 mm (wide)×350 mm (high) and the container will have an unladen weight of the range of 15 to 30 kg. In those embodiments with two phase change materials and two thermoelectric devices where the container is able to operate in both hot and cold environments, the container will be designed to operate in external temperatures ranging from +40° C. to −20° C. and will have sufficient battery power and phase change material stores to operate at those temperatures for a minimum of 48 hours. The battery power will preferably be provided by 7 AHr, 12V Lead-Acid Battery. Alternatively, the battery could be provided by way of one or more 10 AHr, 4.2V Lithium Ion rechargeable batteries.

It will be seen from FIG. 2 in particular that the two sides of the device are larger than the central portion and this provides great protection to the lid and lid fasteners should the device be dropped during transit. It is envisaged that the container will be capable of withstanding a 2 meter drop test. These side portions or wings, as they are also referred to, are an ideal location for the first and second (if provided) phase change materials.

Another important aspect of the present invention is that the container is provided with a temperature sensor that is used to monitor the temperature of the storage compartment 15. The readings from this sensor may be taken periodically, such as every few seconds, every few minutes or every hour. The readings from the sensor are sent to the controller where they are analysed and indeed may be logged in controller memory. It is envisaged that it would be preferable to have a memory that can log of the order of 10,000 records. The temperature sensor may be wired or may communicate with the controller over a wireless communication technology, such as, but not limited to, Bluetooth. Indeed, the container 1 may be provided with a data port for receipt of a plug or other connector to allow programming or communication with the controller by an external device or indeed the controller may be adapted for wireless communications.

Preferably, the container will be provided with a display such as, but not limited to, an LCD display. This display could have a timer illustrated thereon indicating the battery charge state and or the amount of battery charge remaining and the time remaining before the battery is fully discharged and no longer capable of operating the peltier devices 33, 39. Furthermore, preferably the container will be provided with straps for carriage and securing the container in transit.

In the embodiments shown in FIGS. 1 to 12 inclusive, only one peltier device 23, 33, 39 is shown in contact with the heat sink 21, the first phase change material 31 and the second phase change material 37 respectively. It will be understood that more than one peltier device may be provided in contact with each of the heat sink 21, the first phase change material 31 and the second phase change material 37 and these are not limited to the use of a single peltier device.

In the embodiments shown, the substance used in the first and the second phase change materials could be water, water with an additive to vary the freezing point of water, or indeed another liquid that has a suitable phase transition temperature. Pure (i.e. distilled) water could be provided in one or both chambers for the phase change material. The phase change materials will be stored in reservoir containers that are either expansible or that have means to accommodate expansion of the phase change material as it transitions from a liquid to a solid. This is to prevent rupture of the reservoir containers.

It will be understood that the volume of phase change materials required will depend on a number of factors including: 1) the length of time that the phase change material is required to operate; 2) the conditions in which the phase change material is required to operate; and 3) the characteristics of the phase change material including the amount of energy that may be stored per unit volume (the energy storage density) of the phase change material. It is envisaged that approximately 2 litres of phase change material used to cool the storage compartment and approximately 1 litre of phase change material used to heat the storage compartment will be sufficient for most typical materials and operating conditions. In the third embodiment of the invention shown in FIGS. 17 to 20 inclusive, approximately 4 litres of water are provided as the phase change material 31.

Throughout the specification, the portable temperature controlled container 1, 61, 81 has been described for use in the transport of highly-temperature-sensitive goods such as pharmaceuticals and vaccines. However, it will be understood that the present invention, although particularly suited for those purposes, is not so limited. Indeed, the container according to the present invention could be used to transport other items including, but not limited to, organs or foodstuffs. Furthermore, it is envisaged that the container may be designed to operate at different temperature ranges than those described throughout the specification and indeed the device may vary from the dimensions specified above without departing from the scope of the present invention.

In this specification the terms "comprise, comprises, comprised and comprising" and the terms "include, includes, included and including are deemed totally interchangeable and should be afforded the widest possible interpretation.

The invention is in no way limited to the embodiment hereinbefore described but may be varied in both style and construction within the scope of the claims.

The invention claimed is:

1. A portable temperature controlled container comprising:

a body having an outer shell, an inner shell and an insulation layer therebetween, the body defining a storage compartment and an opening to permit access to the storage compartment;

an insulated lid selectively covering the opening in the body;

a first thermoelectric device in thermal communication with the storage compartment;

a first phase change material in thermal communication with the first thermoelectric device;

a rechargeable battery;

a temperature sensor operable to measure the temperature inside the storage compartment;

a controller in communication with the first thermoelectric device and the temperature sensor, the controller being operable to control the first thermoelectric device to regulate the temperature inside the storage compartment; and in which the first thermoelectric device is operable to remove energy in the form of heat from the storage compartment and transfer that energy in the form of heat to the first phase change material; and in which there is provided a second thermoelectric device controlled by the controller, a heat sink in thermal communication with the second thermoelectric device, an air passageway through the body, means for opening and closing the air passageway through the body, and a fan operable to deliver airflow through the air passageway over the heat sink; and in which the first thermoelectric device is sandwiched between the storage compartment and the first phase change material and the second thermoelectric device is sandwiched between the first phase change material and the heat sink.

2. The portable temperature controlled container as claimed in claim 1 in which the storage compartment, first thermoelectric device, first phase change material, second thermoelectric device and heat sink are arranged in a stack configuration with the storage compartment located at the top of the stack, the first thermoelectric device located immediately below the storage compartment, the first phase change material located immediately below the first thermoelectric device, the second thermoelectric device located immediately below the first phase change material and the heat sink located immediately below the second thermoelectric device, at the bottom of the stack.

3. The portable temperature controlled container as claimed in claim 1 in which there is provided a heating element controlled by the controller in thermal communication with the storage compartment.

4. The portable temperature controlled container as claimed in claim 1 in which the first phase change material (31) undergoes a liquid to solid phase transition upon cooling of that phase change material.

5. The portable temperature controlled container as claimed in claim 1 in which the first phase change material has a phase transition temperature of between −2° C. and 8° C.

6. The portable temperature controlled container as claimed in claim 4 in which the first phase change material has a phase transition temperature of 0° C.

7. The portable temperature controlled container as claimed in claim 4 in which the first phase change material is water.

8. The portable temperature controlled container) as claimed in claim 4 in which the first phase change material is a eutectic composition.

9. The portable temperature controlled container as claimed in claim 1 in which the first thermoelectric device is a peltier device.

10. The portable temperature controlled container as claimed in claim 1 in which the insulation layer comprises a vacuum insulation panel.

11. The portable temperature controlled container as claimed in claim 1 in which the insulation layer has a thermal conductivity value of the order of 0.005 W/m·K.

12. The portable temperature controlled container as claimed in claim 1 in which there is provided a heat transfer block intermediate the first phase change material and the first thermoelectric device in thermal communication therewith.

13. The portable temperature controlled container as claimed in claim 1 in which the storage compartment has a volume of between 10 and 20 litres.

* * * * *